US010025213B2

(12) United States Patent
Seki et al.

(10) Patent No.: US 10,025,213 B2
(45) Date of Patent: Jul. 17, 2018

(54) TONER, TONER STORED UNIT, AND IMAGE FORMING APPARATUS

(71) Applicants: Masahiro Seki, Shizuoka (JP); Yoshitaka Sekiguchi, Shizuoka (JP); Satoshi Ogawa, Nara (JP); Naoko Kitada, Kanagawa (JP)

(72) Inventors: Masahiro Seki, Shizuoka (JP); Yoshitaka Sekiguchi, Shizuoka (JP); Satoshi Ogawa, Nara (JP); Naoko Kitada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/557,362

(22) PCT Filed: Feb. 29, 2016

(86) PCT No.: PCT/JP2016/001082
§ 371 (c)(1),
(2) Date: Sep. 11, 2017

(87) PCT Pub. No.: WO2016/147579
PCT Pub. Date: Sep. 22, 2016

(65) Prior Publication Data

US 2018/0031992 A1 Feb. 1, 2018

(30) Foreign Application Priority Data

Mar. 13, 2015 (JP) ..... 2015-051172

(51) Int. Cl.
*G03G 9/087* (2006.01)
*G03G 9/09* (2006.01)

(52) U.S. Cl.
CPC ..... *G03G 9/08797* (2013.01); *G03G 9/08755* (2013.01); *G03G 9/08782* (2013.01); *G03G 9/091* (2013.01); *G03G 9/0904* (2013.01)

(58) Field of Classification Search
CPC ..... G03G 9/08755; G03G 9/08795; G03G 9/08797
See application file for complete search history.

(56) References Cited

U.S. PATENT DOCUMENTS 5,948,584 A 9/1999 Hashimoto et al.
8,673,528 B2 3/2014 Sugimoto et al.
(Continued)

FOREIGN PATENT DOCUMENTS

EP 2 648 045 A1 10/2013
JP 2002-082484 A 3/2002
(Continued)

OTHER PUBLICATIONS

International Search Report and Written Opinion dated Mar. 29, 2016 for counterpart International Patent Application No. PCT/JP2016/001082 filed Feb. 29, 2016.
(Continued)

*Primary Examiner* — Peter L Vajda
(74) *Attorney, Agent, or Firm* — Oblon, McClelland, Maier & Neustadt, L.L.P.

(57) ABSTRACT

A toner including a binder resin, wherein the toner includes a tetrahydrofuran (THF)-insoluble component in a range of from 10% by mass through 40% by mass, wherein the toner has a main peak in a range of from 12,000 through 18,000 in a molecular weight distribution of a THF-soluble component as measured by gel permeation chromatography (GPC), wherein the main peak has a half value width in a range of from 20,000 to 50,000, and wherein the toner includes a component having a molecular weight of 2,000 or less in a range of from 10.0% by mass through 20.0% by mass and a component having a molecular weight of 100,000 or more of 8.0% by mass or less.

5 Claims, 3 Drawing Sheets

(56) References Cited

U.S. PATENT DOCUMENTS

| | | | | |
|---|---|---|---|---|
| 2003/0036010 | A1* | 2/2003 | Suzuki | G03G 9/083 430/106.1 |
| 2006/0141380 | A1 | 6/2006 | Yamazaki et al. | |
| 2006/0177753 | A1* | 8/2006 | Moribe | G03G 5/04 430/108.3 |
| 2008/0175630 | A1 | 7/2008 | Yasunaga et al. | |
| 2008/0227009 | A1 | 9/2008 | Fuwa et al. | |
| 2009/0068579 | A1 | 3/2009 | Ogawa et al. | |
| 2009/0233218 | A1 | 9/2009 | Ogawa | |
| 2010/0215408 | A1 | 8/2010 | Matsuura | |
| 2010/0310980 | A1 | 12/2010 | Sugimoto et al. | |
| 2011/0129773 | A1 | 6/2011 | Shu et al. | |
| 2011/0223532 | A1 | 9/2011 | Sugimoto et al. | |
| 2011/0305986 | A1 | 12/2011 | Ogawa et al. | |
| 2012/0328976 | A1 | 12/2012 | Seki et al. | |
| 2013/0130171 | A1 | 5/2013 | Watanabe et al. | |
| 2013/0243488 | A1 | 9/2013 | Kojima et al. | |
| 2013/0244155 | A1 | 9/2013 | Satoh et al. | |
| 2013/0244156 | A1 | 9/2013 | Kojima et al. | |
| 2013/0244157 | A1 | 9/2013 | Inoue et al. | |
| 2013/0244162 | A1 | 9/2013 | Yamada et al. | |
| 2013/0252160 | A1 | 9/2013 | Nagayama et al. | |
| 2013/0260307 | A1 | 10/2013 | Nagayama et al. | |
| 2013/0316280 | A1 | 11/2013 | Yoshida et al. | |
| 2014/0140731 | A1 | 5/2014 | Hozumi et al. | |
| 2014/0322643 | A1 | 10/2014 | Watanabe et al. | |
| 2015/0104739 | A1 | 4/2015 | Nagatomo et al. | |

FOREIGN PATENT DOCUMENTS

| | | | |
|---|---|---|---|
| JP | 2003-215844 | A | 7/2003 |
| JP | 4118498 | B2 | 5/2008 |
| JP | 2010-282146 | A | 12/2010 |

OTHER PUBLICATIONS

Extended European Search Report dated Nov. 29, 2017 in Patent Application No. 16764412.9 ,7 pages.

* cited by examiner

[Fig. 1]
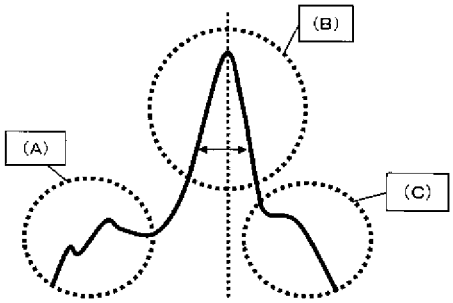
[Fig. 2]
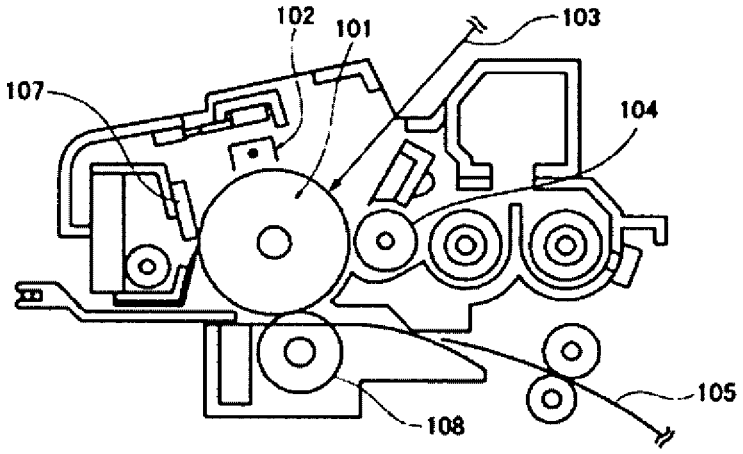
[Fig. 3]
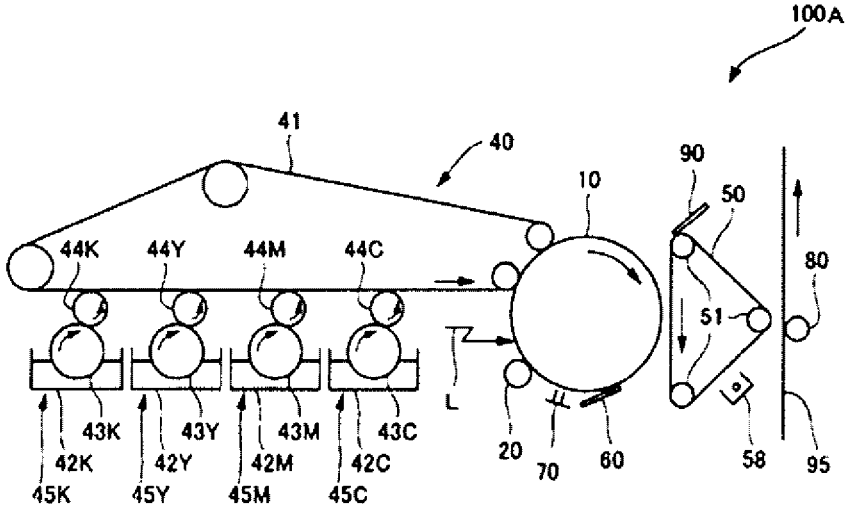

[Fig. 4]
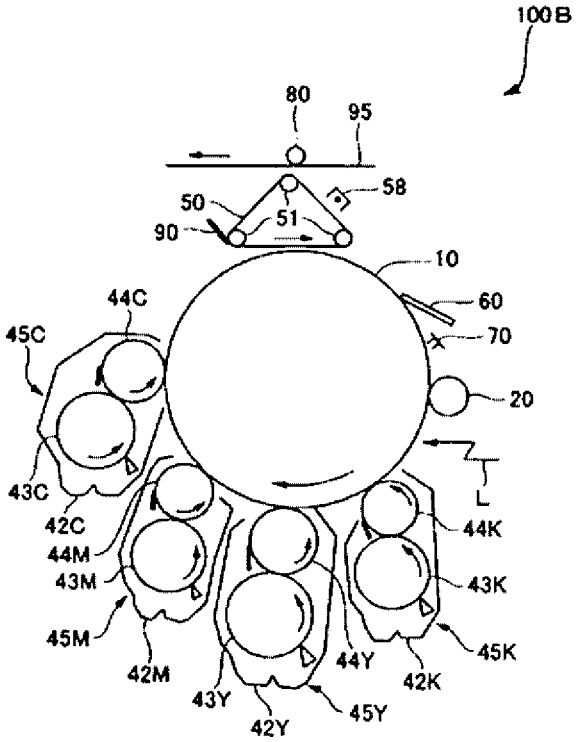
[Fig. 5]
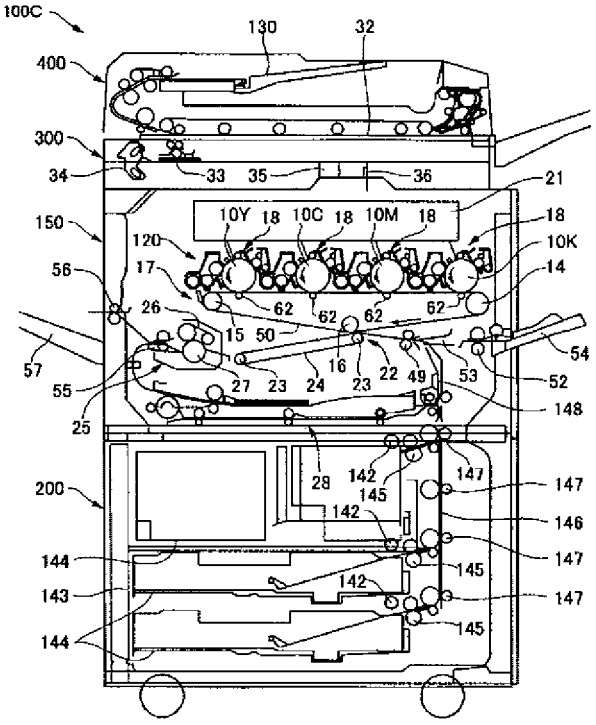

[Fig. 6]
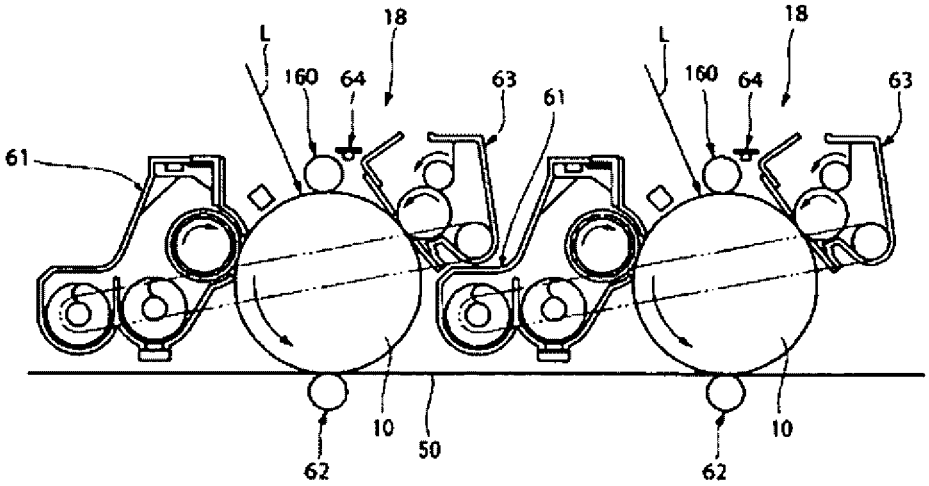

TONER, TONER STORED UNIT, AND IMAGE FORMING APPARATUS

TECHNICAL FIELD

The present disclosure relates to toners, toner stored units, and image forming apparatuses.

BACKGROUND ART

Recently, printers employing one-component development tend to be required to be further miniaturized and prolonged in their service life. In addition, low-temperature fixing of toners used in the printers has been promoted. Therefore, it is urgently necessary for the toners to have improved stress resistance and excellent fixing property.

PTL 1 discloses an electrostatic developing toner that contains a binder resin, a colorant, and a release agent. The toner has a main peak in a range of from 1,000 through 10,000 and a half value width of 15,000 or less in a molecular weight distribution of tetrahydrofuran (THF)-soluble components in the toner (mainly the binder resin) as measured by gel permeation chromatography (GPC). In addition, the toner contains chloroform-insoluble components in a range of from 5% by mass through 40% by mass. PTL 1 reports that, from these properties, a toner that can be fixed at a low temperature, as well as a toner for image formation having good hot-offset resistance and heat storability can be provided.

However, the toner described in PTL 1 has unsatisfactory stress resistance. Therefore, the problem that the toner is cracked or chipped when used for the one-component development has not been solved.

Thus, conventional toners have the problem as described below. The conventional toners have unsatisfactory stress resistance in spite of excellent fixing property (low-temperature fixing property and hot-offset resistance). Especially in the one-component development in which the toners tend to be subjected to stress, the toners are cracked or chipped, so that a defect in quality (adhesion to a blade or filming on a photoconductor) due to cracking or chipping of the toners is easily occurred.

CITATION LIST

Patent Literature

PTL 1: Japanese Patent No. 4118498

SUMMARY OF INVENTION

Technical Problem

The present invention aims to solve the above existing problem and achieve the following object. An object of the present invention is to provide a toner that has excellent fixing property (low-temperature fixing property and hot-offset resistance) and satisfactory stress resistance, and that is neither cracked nor chipped even when the toner is used for one-component development.

Solution to Problem

For solving the above problem, a toner according to the present invention includes a binder resin. The toner includes a tetrahydrofuran (THF)-insoluble component in a range of from 10% by mass through 40% by mass. The toner has a main peak in a range of from 12,000 through 18,000 in a molecular weight distribution of a THF-soluble component as measured by gel permeation chromatography (GPC). The main peak has a half value width in a range of from 20,000 to 50,000. The toner includes a component having a molecular weight of 2,000 or less in a range of from 10.0% by mass through 20.0% by mass and a component having a molecular weight of 100,000 or more of 8.0% by mass or less.

Advantageous Effects of Invention

According to the present invention, there can be provided a toner that has excellent fixing property (low-temperature fixing property and hot-offset resistance) and satisfactory stress resistance, and is neither cracked nor chipped even when the toner is used for one-component development.

BRIEF DESCRIPTION OF DRAWINGS

FIG. 1 is a schematic diagram illustrating one exemplary molecular weight distribution of a toner.

FIG. 2 is a schematic diagram illustrating one exemplary process cartridge according to the present invention.

FIG. 3 is a schematic diagram illustrating one exemplary image forming apparatus according to the present invention.

FIG. 4 is a schematic diagram illustrating another exemplary image forming apparatus according to the present invention.

FIG. 5 is a schematic diagram illustrating another exemplary image forming apparatus according to the present invention.

FIG. 6 is a schematic diagram illustrating another exemplary image forming apparatus according to the present invention.

DESCRIPTION OF EMBODIMENTS

A toner, a toner stored unit, and an image forming apparatus according to the present invention will now be described referring to figures. Notably, the present invention is not limited to the below described embodiments and can be changed within the scope that those skilled in the art can conceive. For example, other embodiments, addition, modification, or deletion may be made. Any of the aspects is within the scope of the present invention so long as operation and effect of the present invention are realized thereby.

According to the present invention, a toner includes a binder resin. The toner includes a tetrahydrofuran (THF)-insoluble component in a range of from 10% by mass through 40% by mass. The toner has a main peak in a range of from 12,000 through 18,000 in a molecular weight distribution of a THF-soluble component as measured by gel permeation chromatography (GPC). The main peak has a half value width in a range of from 20,000 to 50,000. The toner includes a component having a molecular weight of 2,000 or less in a range of from 10.0% by mass through 20.0% by mass and a component having a molecular weight of 100,000 or more of 8.0% by mass or less.

According to the present invention, there can be provided a toner that has excellent fixing property (low-temperature fixing property and hot-offset resistance) and satisfactory stress resistance, and is neither cracked nor chipped even when the toner is used for one-component development (that is, even when the toner is a toner for one-component development).

In the present invention, the present inventors have been found a novel technical idea that, in a molecular weight distribution of a toner, sharpening of a main peak and definition of a molecular weight at which the peak is present are very effective for improving cracking or chipping resistance of the toner.

The present inventors conducted extensive studies, and have found it is important that a resin contained in the toner has a main peak in a range of from 12,000 through 18,000 in a molecular weight distribution of a THF-soluble component as measured by GPC and that the main peak has a half value width in a range of from 20,000 to 50,000. This makes it possible to realize a toner having, in particular, more excellent cracking or chipping resistance than that of conventional toners. Thus, the present invention has been completed. The present invention will be described in detail below.

(Toner)

A toner according to the present invention include a THF-insoluble component in a range of from 10% by mass through 40% by mass. It is important that an absolute amount of the THF-insoluble component is less than an absolute amount of a THF-soluble component and that the absolute amount of the THF-insoluble component is in a range of from 10% by mass through 40% by mass. This can improve the low-temperature fixing property and the hot-offset resistance. The THF-insoluble component of less than 10% by mass deteriorates the fixing property and causes cracking or chipping of the toner. The THF-insoluble component of more than 40% by mass deteriorates the low-temperature fixing property.

A method for measuring the THF-insoluble component is not particularly limited, but, for example, may be as follows. Specifically, about 50 mg of a toner is weighed. To this, 10 g of THF is added to thoroughly dissolve the toner. The resultant toner solution is separated by centrifugation. The resultant supernatant is dried to thereby calculate a mass of the solid content in the supernatant. A difference (difference in mass) between the toner and the solid content in the supernatant is determined as the mass of the THF-insoluble component.

FIG. 1 is a schematic diagram illustrating one exemplary molecular weight distribution of the THF-soluble component in the toner as measured by GPC. In FIG. 1, a horizontal axis represents a molecular weight and a vertical axis represents a peak intensity. The region (A) in FIG. 1 represents a low molecular weight region. A component in the low molecular weight region aids in ensuring the low-temperature fixing property. The region (B) in FIG. 1 represents the presence of the main peak in a molecular weight of from 12,000 through 18,000. Control of a molecular weight and a half value width of the peak aids in ensuring toughness of the toner. The region (C) in FIG. 1 represents a high molecular weight region. Decrease of a component in the high molecular weight region can inhibit its influence on a fixing lower limit temperature.

For the purpose of ensuring cracking or chipping resistance, the molecular weight at which the main peak is present and the half value width of the peak in the molecular weight distribution as measured by GPC are key factors. These can be controlled to the predetermined value to define a skeleton region of the molecular weight distribution, the skeleton region being required to achieve the cracking or chipping resistance (see, the region (B) in FIG. 1).

The toner according to the present invention has the main peak in a molecular weight of from 12,000 through 18,000 in the molecular weight distribution of the THF-soluble component as measured by GPC. The main peak has the half value width in a range of from 20,000 to 50,000. As used herein, the term "main peak" refers to a peak having the highest intensity among measured peaks.

Thus, the molecular weight at which the main peak is present and the half value width of the main peak in the molecular weight distribution can be adjusted to prevent the toner from cracking or chipping.

In the present invention, the main peak at a molecular weight of less than 12,000 causes cracking or chipping of the toner. The main peak at a molecular weight of more than 18,000 deteriorates the low-temperature fixing property. The half value width of the main peak of less than 20,000 causes cracking or chipping of the toner. The half value width of the main peak of more than 50,000 deteriorates the low-temperature fixing property.

It is believed that the longer a main chain of the binder resin in the toner is, the better the toughness of the binder resin is. This is because the longer main chain of a resin improves the toughness of the resin. The molecular weight at which the main peak is present can be controlled to the predetermined range to improve the toughness of the binder resin and to prevent the toner from cracking or chipping. A broad molecular weight distribution indicates the presence of the low molecular weight component. Therefore, the half value width can be controlled to the predetermined range to decrease the low molecular weight component which leads to deterioration of the toughness of the binder resin.

In the present invention, the main peak is preferably at a molecular weight in a range of from 15,000 through 18,000 in the molecular weight distribution and the main peak has preferably the half value width in a range of from 35,000 to 50,000.

In the present invention, for the purpose of ensuring the low-temperature fixing property, it is important to control rates of the low molecular weight region and the high molecular weight region in the molecular weight distribution as measured by GPC (see, the regions (A) and (C) in FIG. 1). That is, in the present invention, it is important that the toner includes the component having a molecular weight of 2,000 or less in a range of from 10.0% by mass through 20.0% by mass and the component having a molecular weight of 100,000 or more of 8.0% by mass or less in the molecular weight distribution of the THF-soluble component in the toner as measured by GPC. Excellent low-temperature fixing property can be realized by meeting the above-described condition.

This is because the low molecular weight component in the resin mainly contributes to the fixing lower limit temperature. The content of a gel component (THF-insoluble component) defined above for ensuring the hot-offset resistance can also ensure the fixing property. Thus, the fixing property can be ensured without impairing the stress resistance.

For example, GPC measurement can be made as follows:

Apparatus: GPC-150C (manufactured by Waters Corporation)

Column: SHODEX KF 801 to 807 (manufactured by Showa Denko K.K.)

Temperature: 40 degrees Celsius

Solvent: THF (tetrahydrofuran)

Flow rate: 1.0 mL/min

Sample: Inject 0.1 mL of a sample having a concentration in a range of from 0.05% through 0.6%.

A calibration curve prepared from monodispersed polystyrene standard samples and the resultant molecular weight distribution as measured under the above conditions are used to calculate the number average molecular weight and the weight average molecular weight of the resin.

As for the polystyrene standard sample for preparing the calibration curve, for example, Showdex STANDARD Std. Nos. S-7300, S-210, S-390, S-875, S-1980, S-10.9, S-629, S-3.0 and S-0.580 (manufactured by SHOWA DENKO K.K.), and toluene are used. As for a detector, a refractive index (RI) detector is used.

<Toner Component>

The toner according to the present invention includes a toner base, which contains a binder resin, and optionally other components, and, if necessary, further includes an external additive.

<<Binder Resin>>

The binder resin used in the present invention may be, for example, a polyester resin. The polyester resin is usually obtained through condensation polymerization of an alcohol with a carboxylic acid.

Examples of the alcohol include glycols such as ethylene glycol, diethylene glycol, triethylene glycol, and propylene glycol; 1,4-bis(hydroxymethyl)cyclohexane; etherified bisphenols such as bisphenol A; other divalent alcohol monomers; and trivalent or higher polyvalent alcohol monomers.

Examples of the carboxylic acid include divalent organic acid monomers such as maleic acid, fumaric acid, phthalic acid, isophthalic acid, terephthalic acid, succinic acid, and malonic acid; and trivalent or higher polyvalent carboxylic acid monomers such as 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxy propane, and 1,2,7,8-octane tetracarboxylic acid.

The polyester resin preferably has a glass transition temperature Tg of 55 degrees Celsius or higher, more preferably 60 degrees Celsius or higher in terms of heat storability.

As described above, the polyester resin is the most suitable resin component in the toner. However, other resins may be used in combination, so long as they do not impair toner performance. Examples of usable resins other than the polyester resin include: styrene-based resins (homopolymers or copolymers containing styrene or a substituted styrene) such as polystyrene, chloropolystyrene, poly(alpha-methylstyrene), a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylic acid ester copolymer (e.g., a styrene/methyl acrylate copolymer, a styrene/ethyl acrylate copolymer, a styrene/butyl acrylate copolymer, a styrene/octyl acrylate copolymer, and a styrene/phenyl acrylate copolymer), a styrene/methacrylic acid ester copolymer (e.g., a styrene/methyl methacrylate copolymer, a styrene/ethyl methacrylate copolymer, a styrene/butyl methacrylate copolymer, and a styrene/phenyl methacrylate copolymer), a styrene/methyl alpha-chloroacrylate copolymer, and a styrene/acrylonitrile/acrylic acid ester copolymer; a vinyl chloride resin; a styrene/vinyl acetate copolymer; a rosin-modified maleic acid resin; a phenolic resin; an epoxy resin; a polyethylene resin; a polypropylene resin; an ionomer resin; a polyurethane resin; a silicone resin; a ketone resin; an ethylene/ethyl acrylate copolymer; a xylene resin; a polyvinyl butyral resin; petroleum-based resins; and hydrogenated petroleum-based resins.

A method for manufacturing the above resins is not particularly limited. For example, bulk polymerization, solution polymerization, emulsion polymerization, or suspension polymerization may be used.

Like the polyester resin, the above resins preferably have the glass transition temperatures Tg of 55 degrees Celsius or higher, more preferably 60 degrees Celsius or higher in terms of heat storability.

<<Release Agent>>

In the present invention, the release agent used in the toner may be any known release agent. In particular, non-free fatty acid carnauba wax, montan wax, and oxidized rice wax may be used alone or in combination.

The carnauba wax is preferably microcrystalline, and has an acid value of 5 or less and a particle diameter of 1 micrometer or smaller when dispersed in the binder resin.

The montan wax generally refers to a montan-based wax refined from a mineral. Like the carnauba wax, the montan wax is preferably microcrystalline and has an acid value in a range of from 5 through 14.

The oxidized rice wax is an aerially oxidized rice bran wax. The oxidized rice wax preferably has an acid value in a range of from 10 through 30.

Examples of other usable release agents that may be used in combination include any conventionally known release agent such as a solid silicone varnish, a higher fatty acid, a higher alcohol, a montan-based ester wax, and a low-molecular weight polypropylene wax.

These release agents are used in a range of from 1 part by mass through 20 parts by mass and preferably in a range of from 2 parts by mass through 10 parts by mass relative to 100 parts by mass of the binder resin in the toner.

<<Colorant>>

In the toner of the present invention, any conventionally known dye and pigment may be used as a colorant. Examples thereof include carbon black, lamp black, iron black, aniline blue, phthalocyanine blue, phthalocyanine green, Hansa yellow G, rhodamine 6C lake, calco oil blue, chrome yellow, quinacridone, benzidine yellow, rose bengal, and triallyl methane-based dyes. These may be used alone or in combination and may be used both as a black toner and a full-color toner.

These colorants are typically used in a range of from 1% by mass through 30% by mass, preferably in a range of from 3% by mass through 20% by mass relative to the resin component of the toner.

<<Charging Control Agent>>

As for the charging control agent, any conventionally known charging control agent such as a nigrosine dye, a metal complex salt dye, and a quaternary ammonium salt may be used alone or in combination. These charging control agents are used in a range of from 0.1 parts by mass through 5 parts by mass, preferably in a range of from 1 part by mass through 3 parts by mass relative to 100 parts by mass of the binder resin in the toner. Additionally, the charging control agent may be a salicylic acid metal complex, preferably a complex containing a trivalent or higher metal that may be hexa-coordinated. Examples of the trivalent or higher metal include Al, Fe, Cr, and Zr. Of these, those having non-toxic Fe as a central metal are more preferable, and azo iron compounds are particularly preferable. Examples of a commercially available charging control agent include T-77 and T-159 (manufactured by Hodogaya Chemical Co., Ltd.).

Those described above may be used in combination.

<<Other Components>>

The toner of the present invention may optionally include, for example, a flowability modifier.

Any conventionally known flowability modifier such as silicon oxide, titanium oxide, silicon carbide, aluminium oxide, and barium titanate may be used alone or in combination. These flowability modifiers is used in a range of from 0.1 parts by mass through 5 parts by mass, preferably from 0.5 parts by mass through 2 parts by mass relative to 100 parts by mass of the toner.

(Toner Stored Unit)

A toner stored unit of the present invention refers to a unit which has a function of storing a toner and in which the toner is stored. Examples of aspects of the toner stored unit include a toner stored container, a developing device, and a process cartridge.

The toner stored container refers to a container in which a toner is stored.

The developing device refers to a device in which a toner is stored and which includes a developing unit.

The process cartridge includes an image bearer and a developing unit in an integrated state, stores a toner, and is detachably mounted to an image forming apparatus. The process cartridge may further include at least one selected from the group consisting of a charging unit, an exposure unit, and a cleaning unit.

One embodiment of the process cartridge is illustrated in FIG. 2. As illustrated in FIG. 2, the process cartridge according to the present embodiment includes a built-in latent image bearer 101, a charging device 102, a developing device 104, and a cleaning portion 107; and, if necessary, further includes other units. In FIG. 2, the reference number 103 denotes exposure by an exposure device, and the reference number 105 denotes a sheet of recording paper.

The latent image bearer 101 may be the same as those described below regarding image forming apparatuses. The charging device 102 may be any charging member.

An image forming process performed using the process cartridge illustrated in FIG. 2 now will be described. The latent image bearer 101 is charged by the charging device 102 and then subjected to the exposure 103 by an exposure unit (not illustrated) with rotating clockwise. Thus, an electrostatic latent image corresponding to an exposure image is formed on a surface of the latent image bearer.

This electrostatic latent image is developed with a toner by the developing device 104 to obtain a developed image. The resultant developed image is transferred onto a sheet of recording paper 105 by a transfer roller 108, and then printed out. Subsequently, the surface of the latent image bearer from which the image has been transferred is cleaned by the cleaning portion 107, and then subjected to charge-elimination by a charge-eliminating unit (not illustrated). Then, a series of operation described above is repeated.

(Image Forming Method and Image Forming Apparatus)

An image forming method used in the present invention includes an electrostatic latent image forming step (charging step and exposure step), a developing step, a transfer step, and a fixing step; and, if necessary, further includes appropriately selected other steps such as a charge-eliminating step, a cleaning step, a recycling step, and a controlling step.

An image forming apparatus according to the present invention includes an electrostatic latent image bearer; an electrostatic latent image forming unit (charging unit and exposure unit) configured to form an electrostatic latent image on the electrostatic latent image bearer; a developing unit configured to develop the electrostatic latent images with a developing agent to form a visible image; a transfer unit configured to transfer the visible image on a recording medium to form a transferred image; and a fixing unit configured to fix the transferred image on the recording medium; and, if necessary, further includes appropriately selected other units such as a charge-eliminating unit, a cleaning unit, a recycling unit, and a controlling unit.

—Electrostatic Latent Image Forming Step and Electrostatic Latent Image Forming Unit—

The electrostatic latent image forming step is a step of forming an electrostatic latent image on an electrostatic latent image bearer.

A material, a shape, a structure, and a size of the electrostatic latent image bearer (may be referred to as "electrophotographic photoconductor" or "photoconductor") are not particularly limited and may be appropriately selected from known electrostatic latent image bearers. As for the shape of the electrostatic latent image bearer, a drum-shaped electrostatic latent image bearer is suitably used. Examples of the material of the electrostatic latent image bearer include an inorganic photoconductor (e.g., amorphous silicon and selenium), and an organic photoconductor (OPC) (e.g., polysilane and phthalopolymethine). Of these, the organic photoconductor (OPC) is preferable because a higher definition image can be obtained.

The electrostatic latent image may be formed, for example, by uniformly charging a surface of the electrostatic latent image bearer, and then exposing it imagewise to light, and may be formed with the electrostatic latent image forming unit.

The electrostatic latent image forming unit includes a charging unit (charger) configured to uniformly charge the surface of the electrostatic latent image bearer; and an exposure unit (exposure device) configured to expose the surface of the electrostatic latent image bearer imagewise to light.

The charging may be performed with the charger, for example, by applying a voltage to the surface of the electrostatic latent image bearer.

The charger is not particularly limited and may be appropriately selected depending on the intended purpose. For example, known contact chargers equipped with a conductive or semi-conductive roller, brush, film, or rubber blade and non-contact chargers employing corona discharge (e.g., corotron and scorotron) may be used.

The charger preferably is disposed in contact or non-contact with the electrostatic latent image bearer, and charges the surface of the electrostatic latent image bearer by applying superimposed AC voltage and DC voltage.

The charger is preferably a charging roller disposed adjacent to the electrostatic latent image bearer in a non-contact manner via a gap tape, and configured to charge the surface of the electrostatic latent image bearer by applying superimposed AC voltage and DC voltage to the charging roller.

The exposure may be performed with the exposure device, for example, by exposing the surface of the electrostatic latent image bearer imagewise to light.

The exposing device is not particularly limited and may be appropriately selected depending on the intended purpose, so long as it can expose the surface of the electrostatic latent image bearer which has been charged by the charger imagewise to light. Examples of the exposure device include various exposure devices such as a copy optical system, a rod lens array system, a laser optical system, and a liquid crystal shutter optical system.

Note that, in the present invention, a back-exposure method may be employed in which the electrostatic latent image bearer is exposed imagewise to light from the back side.

—Developing Step and Developing Unit—

The developing step is a step of developing the electrostatic latent image with the toner to form a visible image.

The visible image may be formed with the developing unit, for example, by developing the electrostatic latent image with the toner.

For example, a developing unit including a developing device configured to store the toner and to apply the toner to the electrostatic latent image in a contact or non-contact manner may be suitably used. More preferable is a developing device including a container in which the toner is stored.

The developing device may be a single-color or multi-color developing device. For example, a suitable developing device includes a rotatable magnetic roller and a stirrer for charging the toner with friction generated during stirring.

In the developing device, toner particles and carrier particles are stirred and mixed together, so that the toner particles are charged by friction generated therebetween. The charged toner particles are retained in the chain-like form on a surface of the magnetic roller which is rotating to form magnetic brushes. The magnetic roller is disposed adjacent to the electrostatic latent image bearer (photoconductor) and thus, some of the toner particles constituting the magnetic brushes on the surface of the magnet roller are transferred onto the surface of the electrostatic latent image bearer (photoconductor) by the action of electrically attractive force. As a result, the electrostatic latent image is developed with the toner to form a visible image on the surface of the electrostatic latent image bearer (photoconductor).

—Transfer Step and Transfer Unit—

The transfer step is a step of transferring the visible image onto a recording medium. A preferable aspect of the transfer step includes primarily transferring the visible image onto an intermediate transfer member and then secondarily transferring the visible image onto the recording medium. A more preferable aspect of the transfer step includes a primary transfer step in which visible images of each color of toners of two or more colors, preferably, a full color toner are transferred onto the intermediate transfer member to form a composite transfer image and a secondary transfer step in which the composite transfer image is transferred onto the recording medium.

The transfer may be performed with the transfer unit, for example, by charging the visible image on the electrostatic latent image bearer (photoconductor) using a transfer charger. The transfer unit preferably includes a primary transfer unit configured to transfer the visible image onto the intermediate transfer medium to form a composite transfer image and a secondary transfer unit configured to transfer the composite transfer image onto the recording medium.

Note that, the intermediate transfer member is not particularly limited and may be appropriately selected from known transfer members depending on the intended purpose. Suitable example of the intermediate transfer member includes a transfer belt.

The transfer unit (primary transfer unit and secondary transfer unit) preferably includes a transfer device configured to transfer the visible image on the electrostatic latent image bearer (photoconductor) to the recording medium via stripping charging. The number of the transfer unit may be one, or two or more.

Examples of the transfer device include a corona transfer device employing corona discharge, a transfer belt, a transfer roller, a pressing transfer roller, and an adhesive transferring device.

The recording medium is not particularly limited and may be appropriately selected from known recording media (recording paper).

—Fixing Step and Fixing Unit—

The fixing step is a step of fixing a visible image transferred on recording medium by a fixing device. The fixing step may be performed every after an image of each color is transferred onto the recording medium; or the fixing step may be performed at one time after images of all colors are transferred on top of one another on the recording medium.

The fixing device is not particularly limited and may be appropriately selected depending on the intended purpose, but is preferably a known heating-pressurizing unit. Examples of the heating-pressurizing unit include a combination of a heat roller and a press roller; and a combination of a heat roller, a press roller, and an endless belt. The fixing device preferably is a device which includes a heating member equipped with a heat generating element, a film configured to be brought into contact with the heating member, and a pressurizing member configured to be pressed against the heating member via the film; and which is configured to pass recording medium on which an unfixed image is formed between the film and the pressurizing member to fix the unfixed image with heat. Typically, the heating-pressurizing unit is preferably heated at 80 degrees Celsius through 200 degrees Celsius.

Note that, in the present invention, a known optical fixing device may be used instead of or in addition to the fixing step and the fixing unit depending on the intended purpose.

—Other Steps and Other Units—

The charge-eliminating step is a step of applying a charge-eliminating bias to the electrostatic latent image bearer to eliminate charge thereof, and may be performed by a charge-eliminating unit.

The charge-eliminating unit is not particularly limited and may be appropriately selected from known charge-eliminating devices depending on the intended purpose, as long as it can apply the charge-eliminating bias to the electrostatic latent image bearer. For example, a charge-eliminating lamp may be suitably used.

The cleaning step is a step of removing the toner remaining on the electrostatic latent image bearer, and can be suitably performed by a cleaning unit.

The cleaning unit is not particularly limited and may be appropriately selected from known cleaners, so long as it can remove the toner reaming on the electrostatic latent image bearer. Suitable examples of the cleaning unit include a magnetic brush cleaner, an electrostatic brush cleaner, a magnetic roller cleaner, a blade cleaner, a brush cleaner, and a web cleaner.

The recycle step is a step of recycling the toner which has been removed in the cleaning step to the developing unit, and may be suitably performed by the recycle unit. The recycle unit is not particularly limited and may be known conveying units.

The controlling step is a step of controlling each of the above steps, and may be suitably performed by a controlling unit.

The controlling unit is not particularly limited and may be appropriately selected depending on the intended purpose, so long as it can control the operation of each of the above units. Examples of the controlling unit include devices such as a sequencer and a computer.

FIG. 3 illustrates the first example of an image forming apparatus according to the present invention. An image forming apparatus 100A includes a photoconductor drum 10, a charging roller 20, an exposure device, a developing device 40, an intermediate transfer belt 50, a cleaning device 60 including a cleaning blade, and a charge-eliminating lamp 70.

The intermediate transfer belt 50 is an endless belt stretched around three rollers 51 disposed in a loop of the belt, and can be moved in a direction indicated by the arrow in this figure. Some of the three rollers 51 serve also as a transfer bias roller capable of applying a transfer bias (primary transfer bias) to the intermediate transfer belt 50. The cleaning device 60 including a cleaning blade is disposed adjacent to the intermediate transfer belt 50. Also, a transfer roller 80 is disposed so as to face the intermediate transfer belt 50 and the transfer roller is capable of applying a transfer bias (secondary transfer bias) for transferring a toner image onto a sheet of transfer paper 95. Around the intermediate transfer belt 50, a corona charging device 58 configured to apply charges to the toner image which has been transferred on the intermediate transfer belt 50 is disposed between a contact portion of the photoconductor drum 10 with the intermediate transfer belt 50 and a contact portion of the intermediate transfer belt 50 with the sheet of transfer paper 95 in a rotational direction of the intermediate transfer belt 50.

The developing device 40 is composed of a developing belt 41; and a black developing unit 45K, a yellow developing unit 45Y, a magenta developing unit 45M, and a cyan developing unit 45C, which are disposed around the developing belt 41 in a parallel manner. Note that, a developing unit 45 for each color includes a developing agent stored section 42, a developing agent supplying roller 43, and a developing roller 44 (developing agent bearer). Moreover, the developing belt 41 is an endless belt stretched around a plurality of rollers, and can be moved in a direction indicated by the arrow in this figure. A part of the developing belt 41 is in contact with the photoconductor drum 10.

A method for forming an image using the image forming apparatus 100A now will be described. The charging roller 20 uniformly charges a surface of the photoconductor drum 10. Then, the exposure device (not illustrated) exposes the thus charged photoconductor drum 10 to light L to thereby form an electrostatic latent image. The electrostatic latent image formed on the photoconductor drum 10 is developed with a toner supplied from the developing device 40 to thereby form a toner image. The toner image on the photoconductor drum 10 is transferred (primarily transferred) onto the intermediate transfer belt 50 with a transfer bias applied from the rollers 51, and then is transferred (secondarily transferred) onto the sheet of transfer paper 95 with a transfer bias applied from the transfer roller 80. Meanwhile, a toner remaining on the photoconductor drum 10 from which the toner image has been transferred to the intermediate transfer belt 50 is removed by the cleaning device 60, and the charges on the photoconductor drum 10 are eliminated by the charge-eliminating lamp 70.

FIG. 4 illustrates the second example of an image forming apparatus used in the present invention. An image forming apparatus 100B has the same configuration as the image forming apparatus 100A, except that the developing belt 41 is not disposed, and that the black developing unit 45K, the yellow developing unit 45Y, the magenta developing unit 45M, and the cyan developing unit 45C are disposed directly facing the periphery of the photoconductor drum 10.

FIG. 5 illustrates the third example of an image forming apparatus used in the present invention. An image forming apparatus 100C is a tandem color image forming apparatus and includes a copying machine main body 150, a sheet feeding table 200, a scanner 300, and an automatic document feeder (ADF) 400.

An intermediate transfer belt 50 is disposed at a central portion of the copying device main body 150, is an endless belt stretched around three rollers 14, 15, and 16, and can be moved in the direction indicated by the arrow in this figure. A cleaning device 17 including a cleaning blade is disposed adjacent to the roller 15. The cleaning device is configured to remove the toner remaining on the intermediate transfer belt 50 from which the toner image has been transferred to the sheet of the recording paper. Image forming units 120Y, 120C, 120M, and 120K for yellow, cyan, magenta, and black, respectively, are disposed in a parallel manner along the conveying direction so as to face the intermediate transfer belt 50 stretched around rollers 14 and 15.

An exposure device 21 is disposed adjacent to the image forming units 120. A secondary transfer belt 24 is disposed on the side of the intermediate transfer belt 50 opposite to the side on which the image forming units 120 are disposed. Note that, the secondary transfer belt 24 is an endless belt stretched around a pair of rollers 23. The sheet of the recording paper being conveyed on the secondary transfer belt 24 can be brought into contact with the intermediate transfer belt 50 at between the rollers 16 and 23.

A fixing device 25 is disposed adjacent to the secondary transfer belt 24. The fixing device includes a fixing belt 26 which is an endless belt stretched around a pair of rollers and a pressing roller 27 disposed so as to be pressed against the fixing belt 26. Also, a sheet inverting device 28 is disposed adjacent to the secondary transfer belt 24 and the fixing device 25. The sheet inverting device is configured to invert the sheet of the recording paper in the case of forming an image on both sides of the sheet of recording paper.

A method for forming a full-color image using the image forming apparatus 100C now will be described. First, a color document is set on a document table 130 of the automatic document feeder (ADF) 400. Alternatively, the automatic document feeder 400 is opened, a color document is set on a contact glass 32 of the scanner 300, and then the automatic document feeder 400 is closed.

In the case where the color document has been set on the automatic document feeder 400, when a starting switch is pressed, the color document is conveyed to the contact glass 32 and then the scanner 300 is activated. Meanwhile, in the case where the color document has been set on the contact glass 32, the scanner 300 is activated immediately after the starting switch is pressed. Then, a first travelling body 33 including a light source and a second travelling body 34 including a mirror are driven to travel. At that time, the first travelling body 33 irradiates the document with light, and then the second carriage 34 reflects light reflected by the document. The thus-reflected light is received at a reading sensor 36 through an imaging forming lens 35. Thus, the color document is read to obtain image information corresponding to black, yellow, magenta and cyan.

Image information for each color is transmitted to the image forming unit 120 for each color, to thereby form a toner image for each color. As illustrated in FIG. 6, the image forming unit 120 for each color includes a photoconductor drum 10; a charging roller 160 configured to uniformly charge the photoconductor drum 10; an exposing device configured to expose the photoconductor drum 10 to light L based on the image information for each color to form an electrostatic latent image for each color; a developing device 61 configured to develop the electrostatic latent image with the developing agent for each color to form a toner image for each color; a transfer roller 62 configured to transfer the toner image on the intermediate transfer belt 50; a cleaning device 63 including a cleaning blade; and a charge-eliminating lamp 64.

The toner images formed by the image forming units 120 are sequentially transferred (primarily transferred) and superposed on top of one another on an intermediate transfer belt 50, which is stretched around rollers 14, 15, and 16 and is moving, to form a composite toner image.

In the sheet feeding table 200, one of sheet feeding rollers 142 is selectively rotated to feed sheets of recording paper from one of vertically stacked sheet feeding cassettes 144 housed in a paper bank 143. The thus-fed sheets are separated from one another by a separating roller 145. The thus-separated sheet is fed through a sheet feeding path 146, then guided to a sheet feeding path 148 in the copying device main body 150 by a conveying roller 147, and stopped at a registration roller 49.

Alternatively, sheets of recording paper placed on a manual sheet feeding tray 54 are fed by rotating the sheet feeding roller, and the thus-fed sheets are separated from one another by a separating roller 52. The thus-separated sheet is guided to a manual sheet feeding path 53, and stopped at the registration roller 49. Note that, the registration roller 49 is generally grounded in use, but it may be used while a bias is being applied thereto for removing paper dust from the recording paper.

Next, the registration roller 49 is rotated in accordance with the timing of the composite toner image formed on the intermediate transfer belt 50 to thereby feed a sheet of recording paper to between the intermediate transfer belt 50 and the secondary transfer belt 24, so that the composite toner image is transferred (secondarily transferred) onto the sheet of recording paper. Notably, a toner remaining on the intermediate transfer belt 50 from which the composite toner has been transferred is removed by the cleaning device 17.

The sheet of recording paper on which the composite toner image has been transferred is conveyed by the secondary transfer belt 24 to the fixing device 25 where the composite toner image is fixed. Then, the sheet of recording paper is guided to another conveying path by a switching claw 55, and then is discharged in a paper ejection tray 57 by a discharge roller 56. Alternatively, the sheet of recording paper is guided to another conveying path by the switching claw 55 and is inverted by the sheet inverting device 28. Subsequently, an image is also formed on a back surface of the sheet of recording paper, and the sheet of recording paper is discharged in the paper ejection tray 57 by the discharge roller 56.

EXAMPLES

The present invention now will be more specifically described below referring to Examples. However, the present invention is not limited to these Examples. In the following Examples, "%" means "% by mass" and "part(s)" means "part(s) by mass," unless otherwise noted.

(Production of Polyester)

Each of compositions described in Table 1 was placed in a 1 L four-necked round bottom flask equipped with a thermometer, a stirrer, a condenser, and a nitrogen gas introducing tube. The flask was set in a mantle heater, and heated while keeping an inert atmosphere inside the flask by introducing a nitrogen gas through the nitrogen gas introducing tube. Then, 0.05 parts by mass of dibutyltin oxide was added to the flask, followed by reacting together while keeping a temperature at 200 degrees Celsius. Thus, polyesters described in Table 1 were produced.

<Measurement of Physical Properties>

Each of the resultant polyesters was measured for physical properties as follows.

—Measurement of molecular weight (GPC)—

GPC measurement was made under the following conditions:

Apparatus: GPC-150C (manufactured by Waters Corporation)

Column: SHODEX KF 801 to 807 (manufactured by Showa Denko K.K.)

Temperature: 40 degrees Celsius

Solvent: THF (tetrahydrofuran)

Flow rate: 1.0 mL/min

Sample: Inject 0.1 mL of a sample having a concentration in a range of from 0.05% through 0.6%.

A calibration curve prepared from monodispersed polystyrene standard samples and the resultant molecular weight distribution as measured under the above conditions were used to calculate the number average molecular weight and the weight average molecular weight of a resin.

As for the polystyrene standard sample for preparing the calibration curve, Showdex STANDARD Std. Nos. S-7300, S-210, S-390, S-875, S-1980, S-10.9, S-629, S-3.0 and S-0.580 (manufactured by SHOWA DENKO K.K.), and toluene were used. As for a detector, a refractive index (RI) detector was used.

—THF-Insoluble Component—

About 50 mg of a toner was weighed. To this, 10 g of THF was added to thoroughly dissolve the toner. The resultant toner solution was separated by centrifugation. The resultant toner solution is separated by centrifugation. The resultant supernatant was dried to thereby calculate a mass of the solid content in the supernatant. A difference (difference in mass) between the toner and the solid content in the supernatant was determined as the mass of the THF-insoluble component.

Formulations and physical properties of polyesters are described in Table 1. Note that, in this Table, "Acid component" and "Alcohol component" are described in "parts by mass," and "THF-insoluble component" is described in "%." "Mw" denotes a weight average molecular weight, and "Mp" denotes a main peak. Numeral values described in the row "Mp" represent molecular weights at which the main peaks are present.

TABLE 1

| | | Resin 1 | Resin 2 | Resin 3 | Resin 4 | Resin 5 | Resin 6 | Resin 7 | Resin 8 | Resin 9 |
|---|---|---|---|---|---|---|---|---|---|---|
| Acid component | Terephthalic acid | 25 | | | 20 | | | 35 | 35 | |
| | Fumaric acid | 15 | 35 | 35 | | 35 | 35 | | | 35 |
| | Succinic acid | 15 | 15 | 15 | | | 15 | | | |
| | Trimellitic anhydride | | | | 20 | 15 | | | 10 | 15 |
| | Dimethyl terephthalate | | | | | | | 10 | | |

TABLE 1-continued

| | | Resin 1 | Resin 2 | Resin 3 | Resin 4 | Resin 5 | Resin 6 | Resin 7 | Resin 8 | Resin 9 |
|---|---|---|---|---|---|---|---|---|---|---|
| Alcohol component | Ethylene glycol | | | | | | | | | |
| | Bisphenol A (2, 2) propylene oxide | 45 | 15 | 15 | 30 | 25 | 40 | 10 | 45 | 25 |
| | Bisphenol A (2, 2) ethylene oxide | | 35 | 35 | 30 | 25 | 10 | 45 | 10 | 25 |
| Physical property | Mw | 16,000 | 55,000 | 40,000 | 13,000 | 35,000 | 60,000 | 13,500 | 8,000 | 50,000 |
| | Mp | 12,000 | 10,000 | 18,000 | 8,000 | 10,000 | 10,000 | 13,500 | 5,000 | 10,000 |
| | THF-insoluble component | 0 | 22 | 20 | 0 | 18 | 5 | 0 | 0 | 25 |

Example 1

A mixture having the following composition was stirred thoroughly in Henschel mixer, heat-melted in a roll-mill at a temperature in a range of from 130 degrees Celsius through 140 degrees Celsius for about 30 min, and then cooled to room temperature. Then, the resultant kneaded product was pulverized by a jet mill or a mechanical pulverized and classified by an air classifier, to thereby obtain a toner base.

—Composition—

Polyester resin 1 50 parts

Polyester resin 2 50 parts

Rice wax (TOWAX-3F16, manufactured by TOA KASEI CO., LTD.)

5 parts

Carbon black (#44, manufactured by Mitsubishi Chemical Corporation)

10 parts

Metal-containing azo compound (T-77, manufactured by Hodogaya Chemical Co., Ltd.) 1 part Hydrophobic silica was added to the resultant toner base in an amount of 0.5% by mass and mixed together to thereby obtain a final product toner.

Example 2

The toner was obtained in the same manner as in Example 1, except that the <Polyester resin 2> was changed to <Polyester resin 3>.

Example 3

The toner was obtained in the same manner as in Example 1, except that the <Polyester resin 1> was changed to <Polyester resin 4> and the <Polyester resin 2> was changed to <Polyester resin 5>.

Example 4

The toner was obtained in the same manner as in Example 1, except that the <Polyester resin 2> was changed to <Polyester resin 6>.

Example 5

The toner was obtained in the same manner as in Example 1, except that the <Polyester resin 1> was changed to <Polyester resin 6>.

Example 6

The toner was obtained in the same manner as in Example 1, except that the <Polyester resin 1> was changed to <Polyester resin 7>.

Example 7

The toner was obtained in the same manner as in Example 1, except that the <Polyester resin 1> was changed to <Polyester resin 9>.

Example 8

The toner was obtained in the same manner as in Example 1, except that the <Polyester resin 1> was changed to <Polyester resin 6> and the <Polyester resin 2> was changed to <Polyester resin 7>.

Comparative Example 1

The toner was obtained in the same manner as in Example 1, except that the <Polyester resin 1> was changed to <Polyester resin 8> and the <Polyester resin 2> was changed to <Polyester resin 9>.

Comparative Example 2

The toner was obtained in the same manner as in Example 1, except that the <Polyester resin 1> was changed to <Polyester resin 4> and the <Polyester resin 2> was changed to <Polyester resin 6>.

(Measurement)

The above toners were subjected to the following measurements.

<GPC Measurement>

The above toners were subjected to the GPC measurement under the following conditions:

Apparatus: GPC-150C (manufactured by Waters Corporation)

Column: SHODEX KF 801 to 807 (manufactured by Showa Denko K.K.)

Temperature: 40 degrees Celsius

Solvent: THF (tetrahydrofuran)

Flow rate: 1.0 mL/min

Sample: Inject 0.1 mL of a sample having a concentration in a range of from 0.05% through 0.6%.

A calibration curve prepared from monodispersed polystyrene standard samples and the resultant molecular weight distribution as measured under the above conditions were used to calculate the number average molecular weight and the weight average molecular weight of the resin.

As for the polystyrene standard sample for preparing the calibration curve, Showdex STANDARD Std. Nos. S-7300, S-210, S-390, S-875, S-1980, S-10.9, S-629, S-3.0 and S-0.580 (manufactured by SHOWA DENKO K.K.), and toluene were used. As for a detector, a refractive index (RI) detector was used.

<THF-Insoluble Component>

About 50 mg of a toner was weighed. To this, 10 g of THF was added to thoroughly dissolve the toner. The resultant toner solution was separated by centrifugation. The resultant supernatant was dried to thereby calculate a mass of the solid content in the supernatant. A difference (difference in mass) between the toner and the solid content in the supernatant was determined as the mass of the THF-insoluble component.

(Evaluation)

The above toners were subjected to the following evaluations.

<Cracking or Chipping Resistance>

To a 250 mL plastic container, were added 50 g of the toner and then 120 g of alumina beads having diameters of 10 mm, followed by stirring in a ball-mill at 150 rpm for 40 hours. After stirring, cracking or chipping resistance was evaluated based on an initial particle diameter and an increased amount of powder components after stirring.

The increased amount of powder components was measured by the Coulter Counter method. As for a device for measuring a particle size distribution of toner particles, COULTER MULTISIZER II (manufactured by Coulter, Inc.) was used.

First, a surfactant (alkylbenzene sulfonate) in a volume in a range of from 0.1 mL through 5 mL was added as a dispersing agent to an aqueous electrolyte solution in a volume in a range of from 100 mL through 150 mL. Here, the aqueous electrolyte solution was an about 1% aqueous NaCl solution prepared using 1st grade sodium chloride, that is, ISOTON-II (manufactured by Coulter, Inc.) was used. Then, a measurement sample in a range of from 2 mg through 20 mg (solid content) was added thereto. The resultant aqueous electrolyte solution in which the sample was suspended was dispersed with an ultrasonic wave disperser for about 1 min through about 3 min. The volume and the number of toner particles or toner were measured by the measurement device using a 100 micrometer aperture to determine the volume particle size distribution and the number particle size distribution thereof. An increased amount (in % by number) of particles having diameters in a range of 2.00 micrometers through 3.00 micrometers was evaluated according to the following criteria.

<Evaluation Criteria>

A: Increased amount was less than 4%.

B: Increased amount was 4% or more but less than 7%.

C: Increased amount was 7% or more but less than 10%.

D: Increased amount was 10% or more.

<Fixing Property>

—Low-Temperature Fixing Property—

The toner was placed in the modified IPSIO SP C220 (manufactured by Ricoh Company, Ltd.), and a non-fixed solid image of a 40 mm square was printed on a sheet of Type 6000 long grain paper (manufactured by Ricoh Company, Ltd.) with the toner deposition amount being adjusted to 10 g/m$^2$.

Next, the sheet on which the non-fixed solid image was printed was fed through the modified fixing unit of IPSIO SP 4510SF (manufactured by Ricoh Company, Ltd.) at a system speed of 240 mm/sec to thereby fix the solid image. This operation was repeated with the fixing temperature being increased from 130 degrees Celsius through 170 degrees Celsius in increments of 5 degrees Celsius. The resultant fixed solid image was visually observed. The first temperature at which the toner was not transferred on a blank portion was determined as the fixing lower limit temperature. Evaluation criteria were as follows.

<Evaluation Criteria>

A: Fixing lower limit temperature was lower than 140 degrees Celsius.

B: Fixing lower limit temperature was 140 degrees Celsius or higher but lower than 150 degrees Celsius.

C: Fixing lower limit temperature was 150 degrees Celsius or higher.

—High Temperature Releasability—

The toner was placed in the modified IPSIO SP C220 (manufactured by Ricoh Company, Ltd.), and a non-fixed solid image of a 40 mm square was printed on a sheet of Type 6000 long grain paper (manufactured by Ricoh Company, Ltd.) with the toner deposition amount being adjusted to 10 g/m$^2$.

Next, the sheet on which the non-fixed solid image was printed was fed through the modified fixing unit of IPSIO SP 4510SF (manufactured by Ricoh Company, Ltd.) at a system speed of 240 mm/sec to thereby fix the solid image. This operation was repeated with the fixing temperature being increased from 150 degrees Celsius through 200 degrees Celsius in increments of 5 degrees Celsius. The resultant fixed solid image was visually observed. The first temperature at which the toner was not transferred on a blank portion was determined as the fixing upper limit temperature. Evaluation criteria were as follows.

<Evaluation Criteria>

A: Fixing upper limit temperature was 190 degrees Celsius or higher.

B: Fixing upper limit temperature was 170 degrees Celsius or higher but lower than 190 degrees Celsius.

C: Fixing upper limit temperature was lower than 170 degrees Celsius.

Evaluation results of Examples and Comparative Examples are presented in Table 2. Note that, in this Table, "THF-insoluble component" is described in "%," and "2,000 or less" and "100,000 or more" are described in "% by mass." Those having a grade of "C" or higher in Comprehensive evaluation were determined as Pass.

TABLE 2

| | | GPC (THF-soluble component) | | | | Quality | | | | |
|---|---|---|---|---|---|---|---|---|---|---|
| | | | | | | Fixing | | | Cracking | Com- |
| | THF-insoluble component | Main peak | Half value width | 2000 or less | 100,000 or more | Lower limit | Upper limit | Comprehensive evaluation | or chipping | prehensive evaluation |
| Ex. 1 | 12 | 12,500 | 45,000 | 15.0 | 7.0 | A | B | B | B | C |
| Ex. 2 | 20 | 17,800 | 35,000 | 12.5 | 8.0 | A | A | A | A | A |

TABLE 2-continued

| | | GPC (THF-soluble component) | | | | Quality | | | | |
|---|---|---|---|---|---|---|---|---|---|---|
| | | | | | | Fixing | | | Cracking | Com- |
| | THF-insoluble component | Main peak | Half value width | 2000 or less | 100,000 or more | Lower limit | Upper limit | Comprehensive evaluation | or chipping | prehensive evaluation |
| Ex. 3 | 23 | 12,500 | 21,000 | 20.0 | 4.3 | A | A | A | C | B |
| Ex. 4 | 20 | 18,000 | 48,000 | 12.0 | 8.0 | B | A | B | A | B |
| Ex. 5 | 20 | 14,500 | 45,000 | 19.5 | 8.0 | B | A | B | A | B |
| Ex. 6 | 14 | 14,900 | 34,061 | 15.2 | 6.1 | A | A | A | A | A |
| Ex. 7 | 16 | 15,800 | 33,000 | 19.5 | 2.1 | A | B | B | C | C |
| Ex. 8 | 20 | 14,500 | 32,000 | 10.2 | 8.0 | B | A | B | B | C |
| Comp. Ex. 1 | 5 | 12,200 | 30,000 | 18.4 | 11.2 | B | C | C | C | D |
| Comp. Ex. 2 | 22 | 5,200 | 14,714 | 26.9 | 3.5 | A | A | A | D | D |

In Table 2, "A", "B", and "C" in the comprehensive evaluation of fixing mean "excellent", "good", and "bad", respectively, and "A", "B", "C", and "D" in the comprehensive evaluation mean "more excellent", "excellent", "good", and "bad", respectively,

DESCRIPTION OF THE REFERENCE NUMERAL

10 electrostatic latent image bearer (photoconductor drum)
10K black electrostatic latent image bearer
10Y yellow electrostatic latent image bearer
10M magenta electrostatic latent image bearer
10C cyan electrostatic latent image bearer
14 roller
15 roller
16 roller
17 cleaning device
18 image forming means
20 charging roller
21 exposure device
22 secondary transfer device
23
23 roller
24 secondary transfer belt
25 fixing device
26 fixing belt
27 pressing roller
28 sheet inverting device
32 contact glass
33 first travelling body
34 second travelling body
35 imaging forming lens
36 reading sensor
40 developing device
41 developing belt
42K developing agent stored section
42Y developing agent stored section
42M developing agent stored section
42C developing agent stored section
43K developing agent supplying roller
43Y developing agent supplying roller
43M developing agent supplying roller
43C developing agent supplying roller
44K developing roller
44Y developing roller
44M developing roller
44C developing roller
45K black developing unit
45Y yellow developing unit
45M magenta developing unit
45C cyan developing unit
49 registration roller
50 intermediate transfer belt
51 roller
52 separating roller
53 manual sheet feeding path
54 manual sheet feeding tray
55 switching claw
56 discharge roller
57 paper ejection tray
24
58 corona charging device
60 cleaning device
61 developing device
62 transfer roller
63 cleaning device
64 charge-eliminating lamp
70 charge-eliminating lamp
80 transfer roller
90 cleaning device
95 transfer paper
100A, 100B, 100C image forming apparatus
120 image forming unit
130 document table
142 sheet feeding roller
143 paper bank
144 sheet feeding cassette
145 separating roller
146 sheet feeding path
147 conveying roller
148 sheet feeding path
150 copying device main body
160 charging roller
200 sheet feeding table
300 scanner
400 automatic document feeder (ADF)

This application claims priority to Japanese application No. 2015-051172, filed on Mar. 13, 2015 and incorporated herein by reference.

The invention claimed is:

1. A toner, comprising, a binder resin, wherein:

the toner comprises a tetrahydrofuran (THF)-insoluble component in a range of from 10% by mass through 40% by mass;

the toner has a main peak in a range of from 12,000 through 18,000 in a molecular weight distribution of a THF-soluble component as measured by gel permeation chromatography (GPC);

the main peak has a half value width in a range of from 20,000 to 50,000; and the toner comprises a component having a molecular weight of 2,000 or less in a range of from 10.0% by mass through 20.0% by mass and a component having a molecular weight of 100,000 or more of 8.0% by mass or less.

2. The toner according to claim 1, wherein:

the toner has the main peak in a range of from 15,000 through 18,000 in the molecular weight distribution; and the main peak has the half value width in a range of from 35,000 to 50,000.

3. The toner according to claim 1, wherein the toner is a toner for one-component development.

4. A toner stored unit, comprising the toner of claim 1 stored in a container, device or cartridge.

5. An image forming apparatus, comprising:

an electrostatic latent image bearer;

an electrostatic latent image forming unit configured to form an electrostatic latent image on the electrostatic latent image bearer;

a developing unit containing a developing agent and configured to develop the electrostatic latent image with the developing agent to form a visible image;

a transfer unit configured to transfer the visible image onto a recording medium to form a transferred image on the recording medium; and a fixing unit configured to fix the transferred image on the recording medium, wherein the developing agent comprises the toner of claim 1.

* * * * *